US005449149A

United States Patent [19]

Popowich

[11] Patent Number: 5,449,149

[45] Date of Patent: Sep. 12, 1995

[54] PANTOGRAPH JACK

[75] Inventor: David J. Popowich, Toronto, Canada

[73] Assignee: Ventra Group, Inc., Ontario, Canada

[21] Appl. No.: 246,087

[22] Filed: May 19, 1994

[51] Int. Cl.[6] ..... B66F 3/22

[52] U.S. Cl. ..... 254/126

[58] Field of Search ..... 254/122, 126, 124, DIG. 1, 254/DIG. 4

[56] References Cited

U.S. PATENT DOCUMENTS

| | | | |
|---|---|---|---|
| 4,848,733 | 7/1989 | Yamauchi et al. | 254/126 |
| 5,131,628 | 7/1992 | Huang . | |
| 5,139,232 | 8/1992 | Bailey | 254/126 |
| 5,161,782 | 11/1992 | Huang | 254/126 |
| 5,176,362 | 1/1993 | Seksaria . | |
| 5,184,806 | 2/1993 | Erschens . | |
| 5,303,898 | 4/1994 | Engel et al. | 254/126 |

FOREIGN PATENT DOCUMENTS

| | | |
|---|---|---|
| 0035115 | 6/1929 | France . |
| 2204559 | 11/1988 | United Kingdom . |
| 2228249 | 8/1990 | United Kingdom . |
| 2238774 | 6/1991 | United Kingdom . |

*Primary Examiner*—Robert C. Watson
*Attorney, Agent, or Firm*—Cushman, Darby & Cushman

[57] ABSTRACT

In a pantograph jack an improvement comprising an extended tube mounted in a joint of the pantograph to extend a threaded annulus towards a shortened screw of the jack in which the extended tube has an integral construction and is positioned in the joint by crimping of tabs about trunnion pins in the joint.

2 Claims, 5 Drawing Sheets

PANTOGRAPH JACK

FIELD OF THE INVENTION

Figure 1:
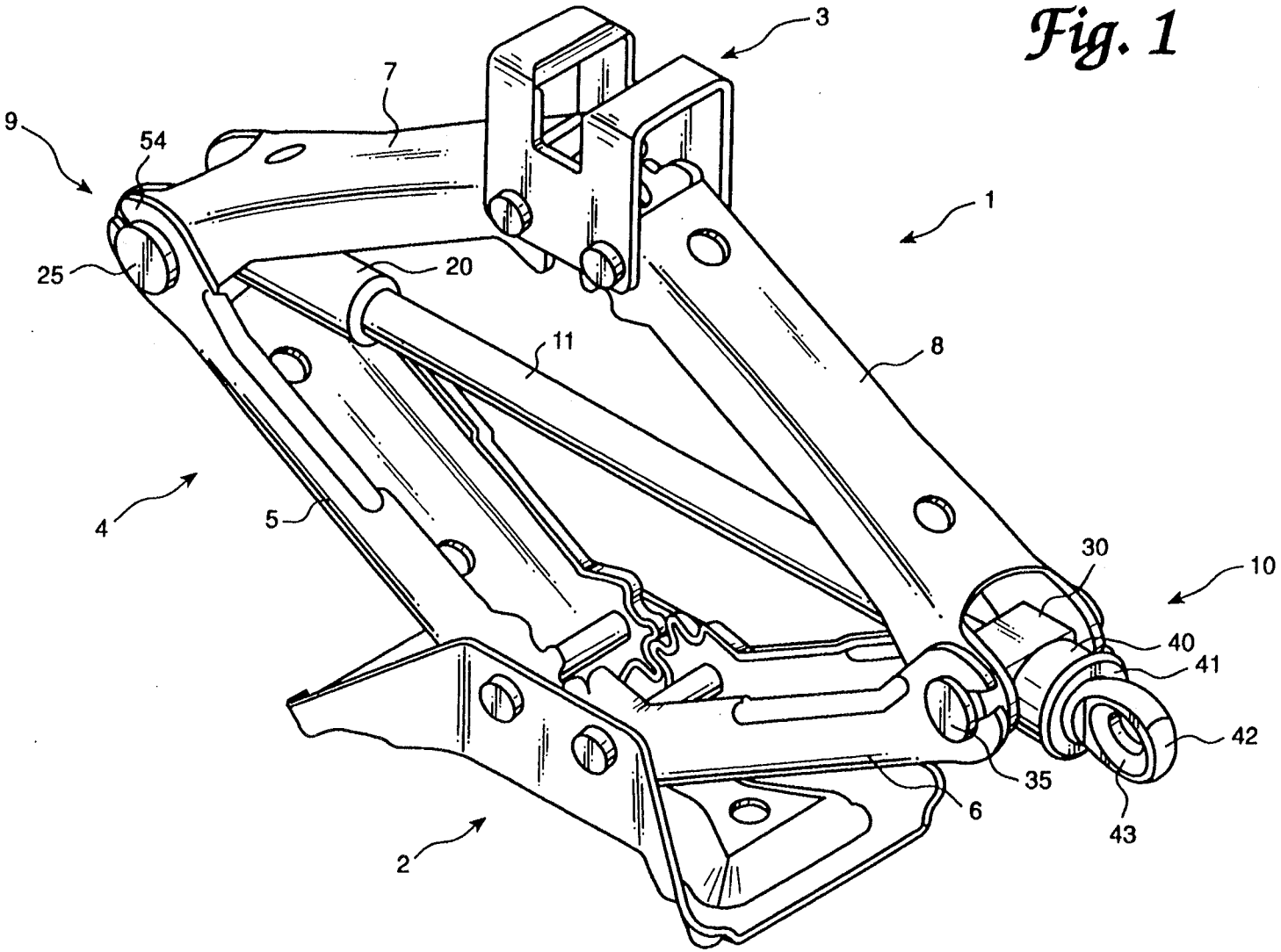

This invention relates to a lifting jack for automobiles and other vehicles. More particularly, it relates to an improvement in the construction of a pantograph jack to simplify the construction of means to reduce the length of the drive screw.

PRIOR ART

A portable jack is often stored in a vehicle to enable a driver to lift the vehicle to effect emergency repairs, for example, to change a tire. One popular type of jack for automobiles is the pantograph jack. Known pantograph jacks typically have four arms hinged in a parallelogram at four joints. One joint is located on a base of the jack. Another joint is positioned at a load rest vertically above the base. Two other free floating joints are located on a horizontal diagonal at opposite corners of the parallelogram formed by the arms. When the free floating joints are drawn together in a horizontal plane the arms extend vertically to lift the load support with respect to the base and vice versa. The relative position of the free floating joints is controlled by a drive screw or threaded shaft which links them together. The two free floating joints are hereafter called the first and second joints. In this description the first joint has a threaded annulus or nut which moves axially along the length of the screw in response to the rotation of the screw. The second joint has a bearing in which the screw turns without changing its axial position with respect to that joint.

Modern automobile design places increasing emphasis on efficient use of space. In turn, jack manufacturers have focused attention on reducing the amount of trunk space required for jack storage. It has been found that it is often more space efficient to store a pantograph jack in a partially opened position rather than in either of the fully extended or lowered positions. To utilize this configuration advantageously for storage, the drive screw should be long enough to span between the free floating joints in the fully lowered position but should not extend outside the parallelogram formed by the jack arms in the partially opened shape. Thus a jack may be stored in otherwise unused space of a similar shape, e.g., within an inside rim of a spare tire.

It is known to reduce the length of a drive screw by provision of an extension from the first joint to extend the threaded annulus towards the second joint. See French Brevet No. 35,115 granted to Emmanuel in 1928.

The present invention is directed to an improvement in the construction of such extension means to simplify the manufacture of same.

THE INVENTION

The invention is an extension means attached to a first joint which projects a threaded annulus towards the second free floating joint thereby reducing the length required of the drive screw. More particularly, the improvement relates to a combination formed by jaws formed at ends of jack arms which interact with each other to form a joint to receive in pivotable connection an integral trunnion, extension leg and threaded annulus.

In general terms the pantograph jack that is the subject of the improvement of this invention has a base to position the jack on a ground support, a load rest to fit under and to carry a vehicle, a parallelogram pantograph and a drive screw. The pantograph has first and second arms hinged at the base, third and fourth arms hinged at the load rest, first and third arms hinged at a first joint and second and fourth arms hinged at a second joint, with the first and second joints on an approximately horizontal diagonal of the pantograph. The drive screw is mounted between the first and second joints to rotate about an axis coextensive with the diagonal.

In the improved construction of this invention an extension means is provided with an integral trunnion, extension leg and threaded annulus. The first and third arms of the pantograph near the first joint terminate in open jaws ends which close about the integral trunnion of the extension means to form in combination a first joint and an extension means pivotally mounted in said jaws of the first and third arms. The extension leg extends from the first joint to project the threaded annulus towards the second joint to engage the drive screw. Rotation of the drive screw within the threaded annulus drives the first joint linearly along the drive screw. A trunnion bearing may be similarly pivotally mounted in the second joint having an opening to receive an unthreaded portion of the drive screw in a rotatable but linearly fixed connection relative to the drive screw.

THE FIGURES

Figure 2:
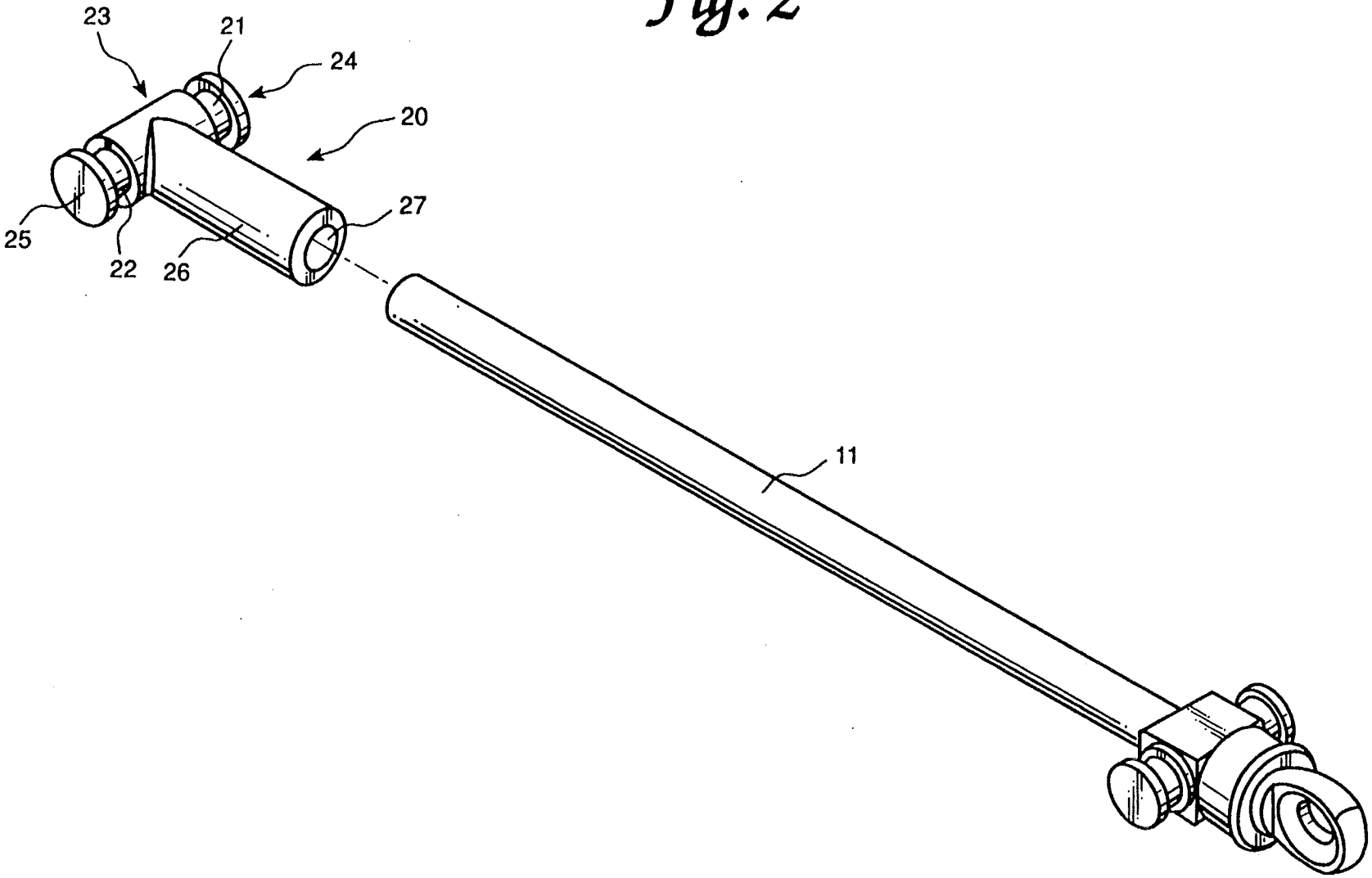
Figure 3:
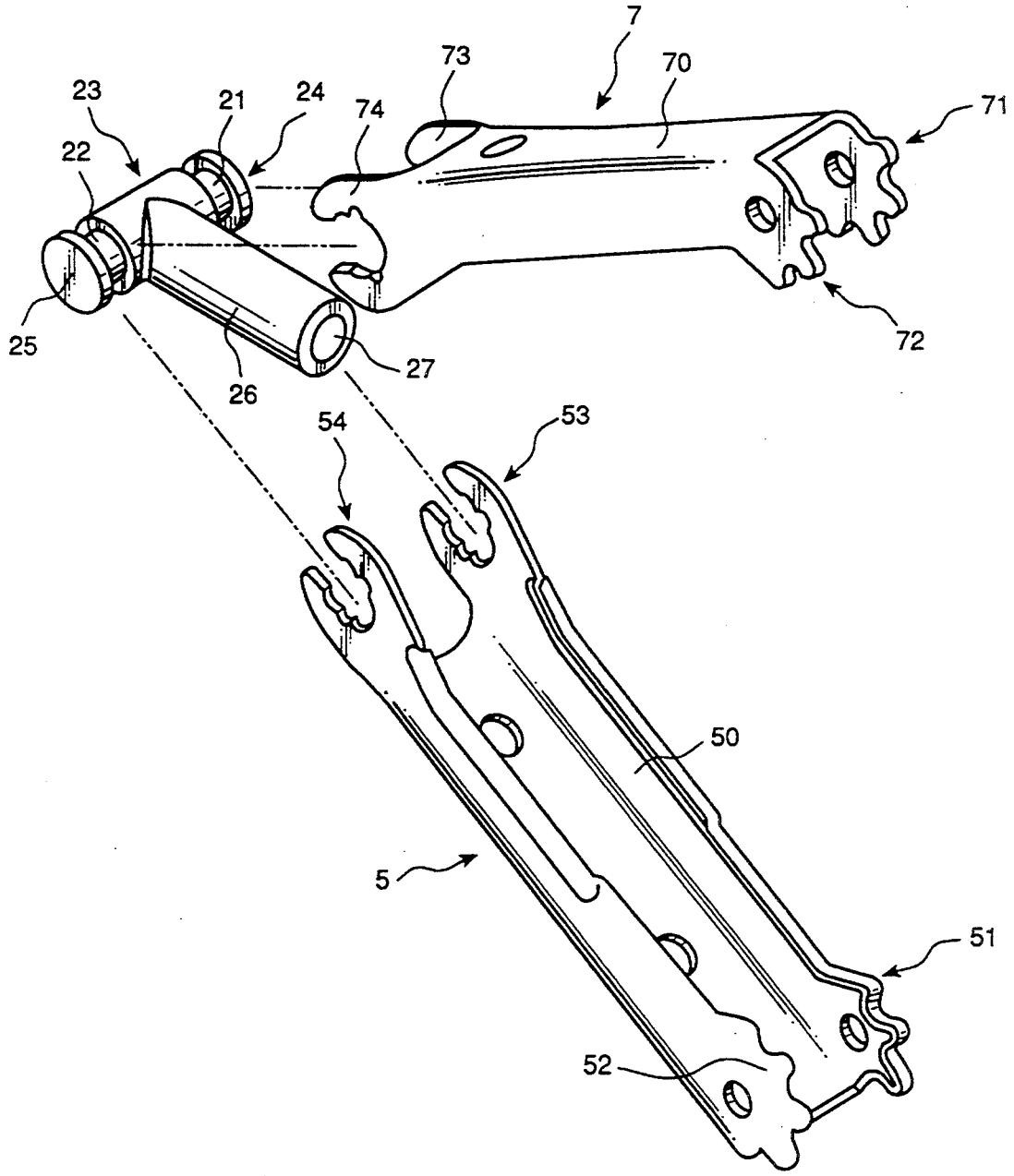
Figure 4:
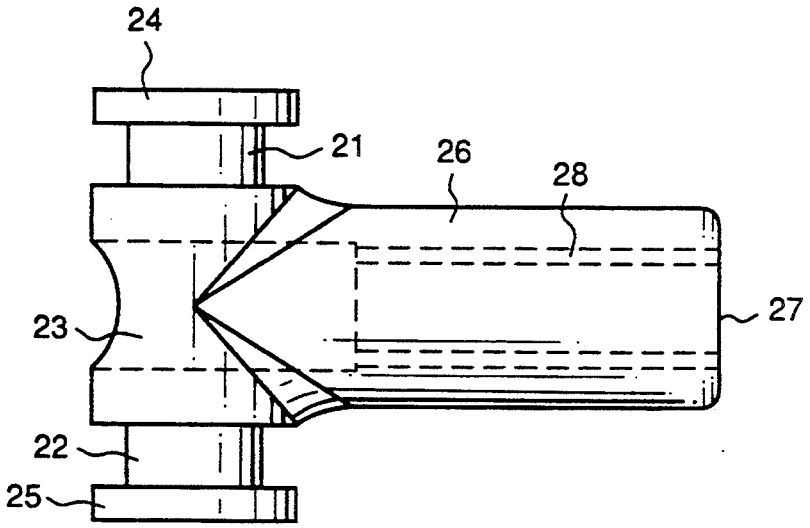
Figure 5:
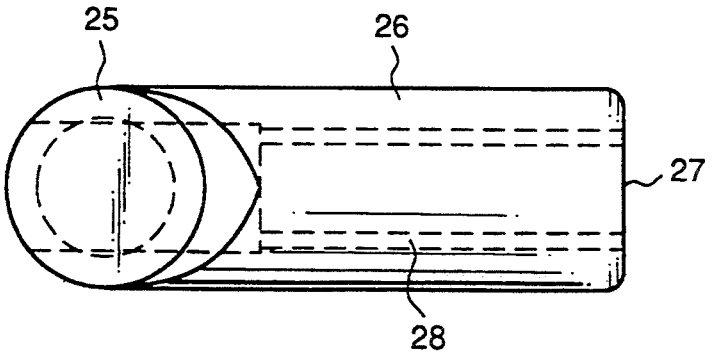
Figure 6:
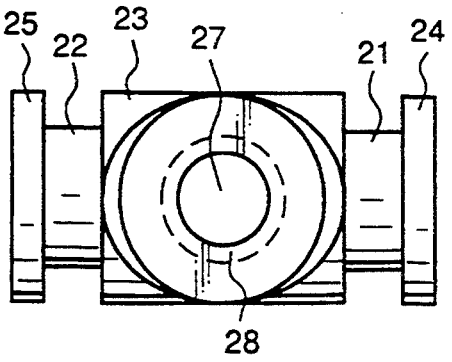
Figure 7:
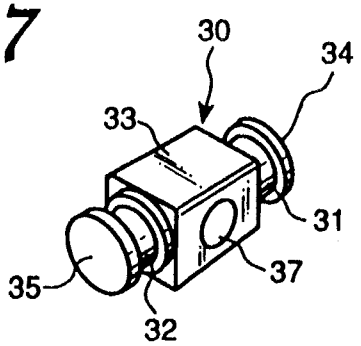

In the figures which illustrate preferred embodiments of the present invention;

FIG. 1 is an isometric view of a pantograph jack having the improvement of this invention, FIG. 2 is an exploded view of the drive screw connection with the integral extension means, FIG. 3 is an illustration of the first and third arms and extension means of the pantograph jack of this invention, FIG. 4 is a top view of the extension means of this invention, FIG. 5 is an side view of the extension means of this invention, FIG. 6 is a end view of the extension means showing a tapped hole to receive the drive screw, FIG. 7 is a perspective of a trunnion pin.

Figure 8:
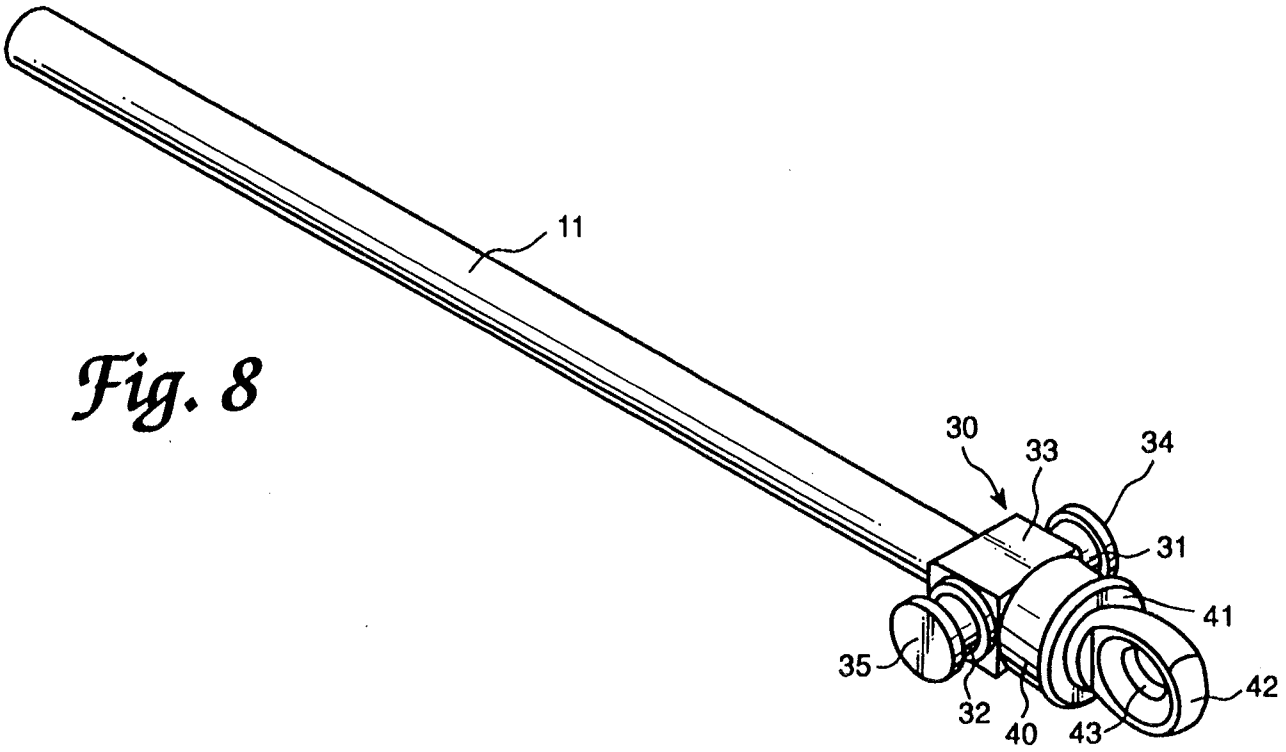

FIG. 8 is a perspective of a drive screw and trunnion pin assembly.

PREFERRED EMBODIMENT

In the figures which illustrate the preferred embodiments of this invention, like numerals indicate like elements.

FIG. 1 illustrates a pantograph jack (1) of this invention. The jack (1) has a base (2) to position the jack (1) on a ground support. A load rest (3) is provided to fit under and to support a vehicle (not shown) during lifting. The jack (1) has a parallelogram shaped pantograph (4) made up of a first arm (5) and a second arm (6) hinged at the base (2), a third arm (7) and a fourth arm (8) hinged at the load rest (3). The first arm (5) and the third arm (7) hinge together at a first joint (9) and the second arm (6) and the fourth arm (8) hinge together at a second joint (10). The first and second joints (9 and 10 ) lie on an approximately horizontal diagonal of the pantograph (4). A drive screw (11) is mounted between said first and second joints (9 and 10) to rotate about an axis coextensive with said diagonal. The drive screw

(11) has a length sufficient to connect the first and second joints (9 and 10) when the jack (1) is in a fully lowered position, i.e., when the load rest (3) is lowered to close proximity to the base (2). An extension means (20) extends from the first joint (9) towards the second joint (10).

An extension means (20) is isolated with a drive screw (11) in FIG. 2. Trunnion pins (21 and 22) are provided on either side of a barrel (23). The trunnion pins otherwise terminate in trunnion caps (24) and (25) respectively. A leg (26) extends from the barrel (23) for a short distance. As detailed in FIGS. 4, 5 and 6, an annulus (27) penetrates through the length of leg (26) and the barrel (23) to permit the drive screw (11) to pass through the extension means (20) as it rotates therein. The threaded portion (28) of the annulus (27) may vary in length depending on the design requirements.

As shown in FIG. 3, the extension means (20) is combined with arms (5) and (7) to form the first joint (9) of the pantograph (4). In the preferred embodiment, the pantograph arms (5), (6), (7) and (8) are each fabricated from a single section which is cut s tamped and formed to the appropriate shape. For example, first arm (5) has a central U-shaped channel (50) having gear teeth (51) and (52) formed at the base end and jaws (53) and (54) formed at the other free floating end. Similarly, third arm (7) has a central U-shaped channel (70) having gear teeth (71) and (72) formed at the load rest end and jaws (73) and (74) formed at the other free floating end. First joint (9) is formed by fitting jaws (53) and (73) about trunnion pin (21) between barrel (23) and trunnion cap (24) while fitting jaws (54) and (74) about trunnion pin (22) between barrel (23) and trunnion cap (25) and then restrictively crimping the jaws (53), (54), (73) and (74) about trunnion pins (21) and (22) to secure the pins (21) and (22) within said jaws but also permitting rotation of the extension means (20) within said jaws.

The trunnion pins (21) and (22) permit the extension means (20) to pivot within joint (9) and thus maintain a horizonal position in any lifting position of the arms (5) and (7). The threads (28) of annulus (27) engage the drive screw (11). As the drive screw (11) rotates in the threaded annulus (27) the first joint (9) is moved linearly along the drive screw (11) either to or from the second joint (10).

As illustrated in FIG. 1, the second joint (10) of the jack (1) has a bearing (30) pivotally mounted relative to the arms (6) and (8). The arms (6) and (8) are similarly fashioned with gear teeth and jaws corresponding to arms (5) and (7). The bearing (30) which is detailed in FIGS. 7 and 8 has trunnion pins (31) and (32), a trunnion barrel (33), trunnion caps (34) and (35) and an annulus (37) through the barrel (33) to receive the drive screw (11) in free rotation. As shown in FIG. 8, the bearing (30) slides over the drive screw (11) to rest against washer (40) which bears against stop (41) which is integrally connected to the drive screw (11) and a lug (42) having an opening (43) to receive a crank (not shown) to operate the jack (1). As an operator turns the crank, the drive screw (11) rotates within bearing (30) without changing its relative linear position therein. The second joint (10) is formed with the bearing (30) secured to pivot within the jaws of arms (6) and (8) in the same manner as described above for the extension means (20).

I claim:

1. In a pantograph jack (1) having:

a base (2) to position the jack (1) on a ground support;

a load rest (3) to fit under and to support a vehicle;

a parallelogram pantograph comprising first (5), second (6), third (7) and fourth (8) arms each said arm having two ends, each said arm having one end with gear teeth and another end with a pair of jaws, said one end of said first and second arms being hinged at the base to mesh the respective gear teeth to synchronize the movement of said arms, said one end of said third and fourth arms being hinged at said load rest to mesh the respective gear teeth to synchronize the movement of said arms, said jaws (53, 54) of the other end of said first arm overlapping with the jaws (73 and 74) of said third arm at a first joint (9), said jaws of the other end of said second arm overlapping with the jaws of said fourth arm at a second joint (10), a drive screw mounted between said first and second joints to rotate about a longitudinal axis, an extension means having integrally a barrel, two trunnion pins laterally extending from the barrel, two trunnion caps terminating the trunnion pins, a longitudinally extending leg and a threaded annulus penetrating longitudinally through the extension means to engage the drive screw in rotatable connection to drive the extension means linearly relative to the drive screw in response to rotation;

a bearing means having a barrel, two trunnion pins laterally extending from the barrel, two trunnion caps terminating the trunnion pins, and an annulus penetrating longitudinally through the extension means to receive the drive screw in slidable connection;

wherein the jaws of the first and third arms are partially crimped about the trunnion pins of the extension means between the trunnion cap and the barrel thereof and the jaws of the second and fourth arms are partially crimped about the trunnion pins of the extension means between the trunnion cap and the barrel thereof to secure the extension means and the bearing means in pivotable connection at said first and second joints respectively.

2. The pantograph jack of claim 1 in which the extension means is an integral casting that is drilled and tapped to form said threaded annulus.

* * * * *